United States Patent [19]

Van Erden

[11] Patent Number: 4,691,372

[45] Date of Patent: Sep. 1, 1987

[54] MANUFACTURE OF MULTI-LAYERED RECLOSABLE BAG MAKING MATERIAL AND BAGS MADE THEREFROM

[75] Inventor: Donald L. Van Erden, Wildwood, Ill.

[73] Assignee: Minigrip, Inc., Orangeburg, N.Y.

[21] Appl. No.: 893,368

[22] Filed: Aug. 5, 1986

[51] Int. Cl.[4] ..... B65D 33/16

[52] U.S. Cl. ..... 383/63; 383/93; 156/66; 493/214

[58] Field of Search ..... 383/63, 68, 93, 95, 383/89, 97; 156/66; 493/214; 24/587

[56] References Cited

U.S. PATENT DOCUMENTS

| | | | |
|---|---|---|---|
| 4,354,541 | 10/1982 | Tilman | 383/63 |
| 4,372,793 | 2/1983 | Herz | 156/66 |
| 4,419,159 | 12/1983 | Herrington | 156/66 |
| 4,428,788 | 1/1984 | Kamp | 383/63 |
| 4,601,694 | 7/1986 | Ausnit | 493/214 |

*Primary Examiner*—Willis Little

*Attorney, Agent, or Firm*—Hill, Van Santen, Steadman & Simpson

[57] ABSTRACT

A method of making materials for bags of the type having reclosable fasteners wherein the wall portions are of a laminate structure and wherein interlockable fastener elements are directly bonded to interior faces of the walls. The lamina of the inner faces of the wall panels serves as the sole bonding agent for the fastener elements. The invention includes a method for making such bags.

5 Claims, 3 Drawing Figures

MANUFACTURE OF MULTI-LAYERED RECLOSABLE BAG MAKING MATERIAL AND BAGS MADE THEREFROM

BACKGROUND OF THE INVENTION

1. Field of the Invention

This invention lies in the field of methods for making multi-layered reclosable bag making material and to certain bag making material and bags produced therefrom.

2. Prior Art

Containers incorporating fasteners having cooperating pressure-releasable and reclosable interlocking members for container closure means have been made by various techniques. By one technique, the interlocking elements are directly integrally extruded with and as part of plastic sheeting to be subsequently formed into containers. By another technique, the interlocking elements are separately extruded onto a film to which the interlocking elements are heat bonded. By another technique, an adhesive is employed to adhere preformed interlocking elements to a preformed film.

A technique for joining a plastic fastener strip continuously to a film is taught by Takahashi U.S. Pat. No. 4,279,677.

In order to improve (reduce) the gas and vapor transmission, or other barrier characteristics of prior art containers in this field, it would be desirable to utilize multi-layered or laminated superimposed plastic sheets. For example, Uramoto U.S. Pat. No. 3,827,472 teaches a flexible bag structure wherein wall members are comprised of a laminate and wherein the inner wall has an integrally co-extruded set of releasable interlocking elements formed therein in adjacent relationship to the bag mouth. However, because of profile density considerations, particularly in the region of the interlocking elements, it is difficult to co-extrude such wall members at high speed in a commercially practical manner and in commercial quality.

In order to improve (reduce) the gas and vapor transmission, or other barrier characteristics of prior art containers in this field, it would be desirable to utilize multi-layered or laminated superimposed plastic sheets. For example, Uramoto U.S. Pat. No. 3,827,472 teaches a flexible bag structure wherein wall members are comprised of a laminate and wherein the inner wall has an integrally co-extruded set of releasable interlocking elements formed therein in adjacent relationship to the bag mouth. However, because of profile density considerations, particularly in the region of the interlocking elements, it is difficult to co-extrude such wall members at high speed in a commercially practical manner and in commercial quality.

In Herz U.S. Pat. Nos. 4,372,793 and 4,341,575, there is provided technology whereby preformed extruded flexible fastener profiles are secured to plastic film by means of an adhesive, such as a hot melt adhesive, which is applied between, and limited to the width of the strips carrying the profiles and the plastic film at the time of mounting. While this method does permit the attainment of high speed production, the method is not adapted for the preparation of laminate sheets by extrusion or other coating techniques.

The art needs new and improved technology for making laminated reclosable bags and material useful for making such bags.

SUMMARY OF THE INVENTION

The present invention provides a method for making a multi-layered reclosable bag making material comprising the steps of sequentially and continuously coating a thermally bonded resin layer over essentially the entire area of a substrate, and then while the coated resin layer is still in an adhesive state, applying thereto and thereby bonding to said substrate by said still adhesive state layer a reclosable fastener strip means.

The invention further provides certain reclosable bag making materials produced by said method, and bag structures formed therefrom.

One object of the present invention is to provide a multi-layered bag making material wherein reclosable fastener strip means is directly heat bonded by one of the layers to surface portions thereof.

One object is to provide a technique for making a multi-layered reclosable bag structure in a simple and reliable manner.

The bonding of the base of a preformed or freshly extruded fastener strip to a multi-layered bag making material by means of one of the layers freshly applied to the other layer has, so far as I am aware, never been heretofore accomplished in this art.

The practice of the present invention requires that the layers employed be directly laminatable to one another or an adhesive layer be used to provide the desired integrally formed composite material for use in making reclosable bag structures.

Another object is to provide a multi-layered bag construction incorporating an essentially all over pair of wall panels wherein each panel has a laminate construction and wherein pressure fastenable and releasable interlocking plastic elements means are bonded by one lamina directly and without intervention of any other bonding means, to opposed wall interior portions of the bag.

Other and further objects, aims, purposes, features, advantages and the like will become manifest to those versed in the art upon making reference to the present specification in combination with the accompanying drawings.

DETAILED DESCRIPTION

Figure 1:
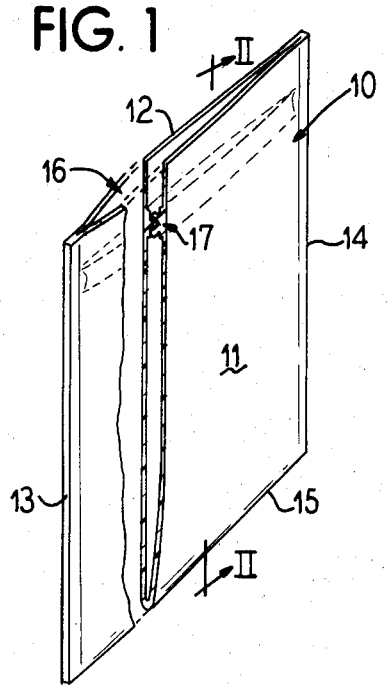
FIG. 1 is a perspective view of one embodiment of a plastic container constructed in accordance with the principles of the present invention.

Extrusion coating and laminating equipment and procedures are generally well known. Typically, a continuous film of molten thermoplastic is extruded from a slot die and applied or coated upon a moving substrate web thereby to coat the substrate and to adhere and laminate the extruded film to the substrate. In extrusion coating, a melted thermoplastic film is combined with the moving web substrate and is then run through the nip formed between a heat-removing chill roll and a pressure-loaded, resiliently covered nip roll. The heat is transferred from the molten thermoplastic allowing the assembly to be stripped from the chill rolls together with the plastic film combined as a surface coating. See, for example, Modern Plastics Encylopedia 1985–1986, pages 198–200; ibid 1984–1985, pages 199–204; and ibid 1982–1983, pages 228–230.

As those skilled in the art appreciate, extrusion coatings themselves are typically functional and provide various properties, such as moisture vapor barriers, liquid barriers, gas transmission barriers grease barriers, heat-sealing surfaces, surface friction modification, variable light reflection surfaces, transparency, opacity, scuff resistance, and the like. Extrusion coatings and laminations are extensively used in food packaging applications.

Usually the substrate web provides the strength or stiffness for the extrusion coated or laminated construction. Examples of substrates include all grades of paper and paperboard, cellophane, plastic films, such as polyethylene, biaxially oriented polyester and polypropylene, nylon film, woven and nonwoven textile webs, metal foils, and the like.

Various polymers can be employed for extrusion coating and laminating. One class of polymers comprises polyolefins with melt indexes of from about 3 to 60. Homopolymers, such as polyethylene (LDPE, HDPE) or polypropylene (PP) are the most common and least expensive. Presently preferred polymers for use in the present invention are copolymers, and include ethylene-vinyl acetate (EVA) or ethylene acrylic acid (EAA) and isomers although such resins are more costly than are homopolymers. Such copolymers are preferred because of their characteristically low heat-seal temperatures (such as associated with EVA) or their selective foil adhesion (such as associated with EAA).

It is presently preferred in the practice of the present invention to employ polymeric substrates, such as polyethylene, to which copolymers, such as EVA, are readily bondable.

As those skilled in the art of extrusion coating appreciate, the adhesion of the extrusion coated polymer to the substrate can be to some degree regulated by coating process running speeds. Typically, low adhesion is achieved at speeds in excess of 2000 feet per minute while relatively high adhesion is achieved at process speeds in the range of from about 500 to 1000 feet per minute, although slower and faster speeds can be employed if desired.

Oxidation of the polymer melt in the gap between the die and the substrate can be used in promote adhesion. Oxidation can be adjusted in that melt temperature can be increased to increase the level of oxidation. Also, the draw down distance can be increased for longer exposure to air. Such an oxidation technique, however, has limitations since, although adhesion to the substrate is improved, excessive oxidation of the melt leads to odor in the polymer and loss of heat-sealing characteristics which can be detrimental in a laminate of this invention particularly when the reclosable fastener strip is applied.

An ozone generator can be utilized from which a higher concentration of ozone is delivered through a nozzle to impinge only upon the side of the melt to be joined to a substrate. This system permits lower melt temperatures, increases adhesion of polymer to substrate, and reduces oxidation on the opposite surface of the polymer so that heat-sealing characteristics are also improved.

Other adhesion promoting systems involve surface treatment of the substrate web. For many paperboard coating applications, for example, a board surface is exposed to direct impingement of a gas flame to singe the paper fiber ends which could potentially protrude through the thin extrusion coating or otherwise prevent intimate contact.

For example, the paperboard utilized in milk cartons is typically overcoated with a polyethylene coating to aid in liquid retention and heat sealability. The paperboard is typically coated on both sides. Adhesion promoting solutions may be employed. However, only the interior continuous extrusion coating for the container to be formed serves as a substrate which locally has applied thereto a reclosable fastener strip in accordance with the present invention.

The surface of a polymeric substrate can be precoated with a solution of a chemical primer in order to enhance adhesion. The solvent following application coating is evaporated and exhausted in a continuous drying oven. Water or water/alcohol based primer coatings are similarly employed. Extremely light primer coatings are possible which often are as low as 0.5 to 1.0 grams per square meter, although higher coating weight may be utilized if desired.

Immediately after application of an extrusion coating, and while the resin comprising the extrusion coating is still in an adhesive state, there is, according to the present invention, continuously applied to the coating along a predetermined path relative to the direction of the movement of the composite laminate structure a reclosable fastener strip means. The term "adhesive state" as used herein, particularly in relation to such an extrusion coating, includes the circumstance that such coating is in a melted or tacky condition such as exists when the material of such coating is at an elevated temperature. Such fastener strip means can either be preformed (in which event the strip means is applied from a roll or the like and can be preheated if desired) or the fastener strip means may be extruded and used as thus formed. The fastener strip preferably comprises a thermoplastic resin which is directly laminatable to the coated polymeric resin layer. Thus, the base face of the fastener strip is applied to the coating resin surface which is still in an adhesive state and the fastener strip is thereby directly bonded to the laminate.

For bag making, it is preferred to employ flexible substrates, such as those comprised of themoplastic resin sheeting or films, paper, or metal foil and equipped with the laminate coating bonded reclosable fastener means which permits the bags to be opened and/or closed easily in use.

Apparatus for extrusion coating and laminating can be conveniently and readily adapted for use in the practice of the present invention. A conventional extruder can be employed. Selection of particular types of equipment will depend upon various considerations, such as the nature of the substrate, maximum and minimum unwind and winder roll diameters, web tension forces, core diameters, and the like.

Figure 2:
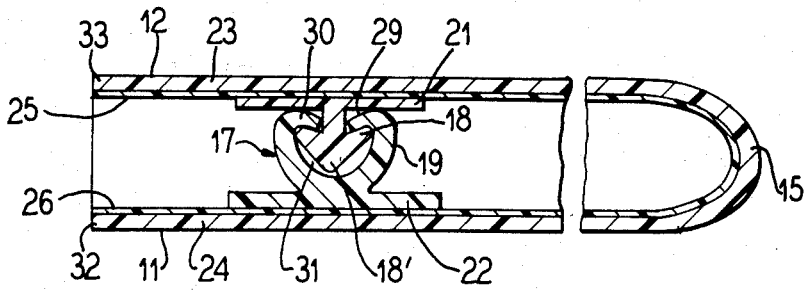
FIG. 2 is an enlarged fragmentary transverse sectional view taken along the line II—II of FIG. 1.

Various multi-layered package and container structures can be fabricated from mult-layered reclosable bag making materials produced by the practice of aspect of the present invention as those skilled in the art will easily appreciate. For example, referring to FIGS. 1 and 2, there is seen a multi-layered plastic bag of the present invention which has a pair of two layered plastic sheet panel sidewalls 11 and 12 that are superimposed one on the other or otherwise arranged in substantially parallel side-by-side relationship. While the illustrated walls 11 and 12 may be generally rectangularly shaped, it will be understood that the walls 11 and 12 of bag 10 may assume configurations other than the rectangular if desired.

The superposed side edges of the walls 11 and 12 are joined together along the seal lines 13 and 14 while the bottom edge of the bag 10 is defined by line 15. The edges 13 and 14 may be bonded together by means of heat sealing, adhesive, or the like. For example, the bottom edge 15 may also comprise a bond between walls 11 and 12, but, in the illustrated embodiment, the walls 11 and 12 actually comprise a single larger sheet which is folded back upon itself to provide an integral bottom wall fold edge at the lower edge 15. The walls 11 and 12 are separated along a top open end of the bag, indicated at 16.

The bag 10 further includes a reclosable fastener 17 which is located parallel and adjacent to the top open end 16. The fastener 17 comprises a pair of cooperating interlocking profiles, or rib and groove members, one of which may be referred to as a male element 18 and the other of which may be referred to as a female element 19. The male and female elements 18 and 19 are formed integrally with their respective base strips 21 and 22. The male element 18 and the female element 19 both upstand vertically from respective base webs 21 and 22. In addition, the male and female elements 18 and 19 extend in substantially straight lines substantially across the entire width of the sheets 11 and 12 with male element 18 being in opposed, generally aligned relationship relative to female element 19.

Walls 11 and 12 are conveniently formed of the same thermoplastic laminate, and the walls 11 and 12 are arranged so that the outside layer 23 of wall 12 comprises the same material as the outside layer 24 of wall 11. Similarly, the arrangement of walls 11 and 12 is such that the inside layer 25 of wall 12 is the same as the inside layer 26 of wall 11. Preferably, the outside layers 23 and 24 are comprised of polyethylene while the inside layers 25 and 26 are comprised of ethylene-vinyl acetate. Preferably, the fastener 17 is comprised of polyethylene and the base webs 21 and 22 are each directly bonded in the assembly to the respective layers 25 and 26. The sheets 11 and 12 may be characterized as being quite flexible and this flexibility enables the fastener 17 to be opened and closed easily without appreciable force.

Thus, in order to close the fastener 17, a slight pressure is applied to the male and female elements 18 and 19 to force the same together along the length of the fastener 17. This pressure causes a tapered arrowhead portion 28 of male element 18 to spread a pair of arms 29 and 30 formed on the female element 19. After the arrowhead portion 28 is completely inserted into a recess 31 formed between the arms 29 and 30, the inherent resiliency of the thermoplastic causes the arms to turn in and become interlocked with the arrowhead portion 28.

To open the fastener 17, it is merely necessary to apply a slight separating force to marginal portions 32 and 33 of the walls 11 and 12, respectively, which extend adjacent the open end 16. The application of this force causes the arm 30 to spread and allows the separation of the arrowhead portion 28 of male element 18 from female element 19, thus opening the top end 16 of the bag 10. The fastner described herein is typical of existing art but is only one of many possible constructions.

Figure 3:
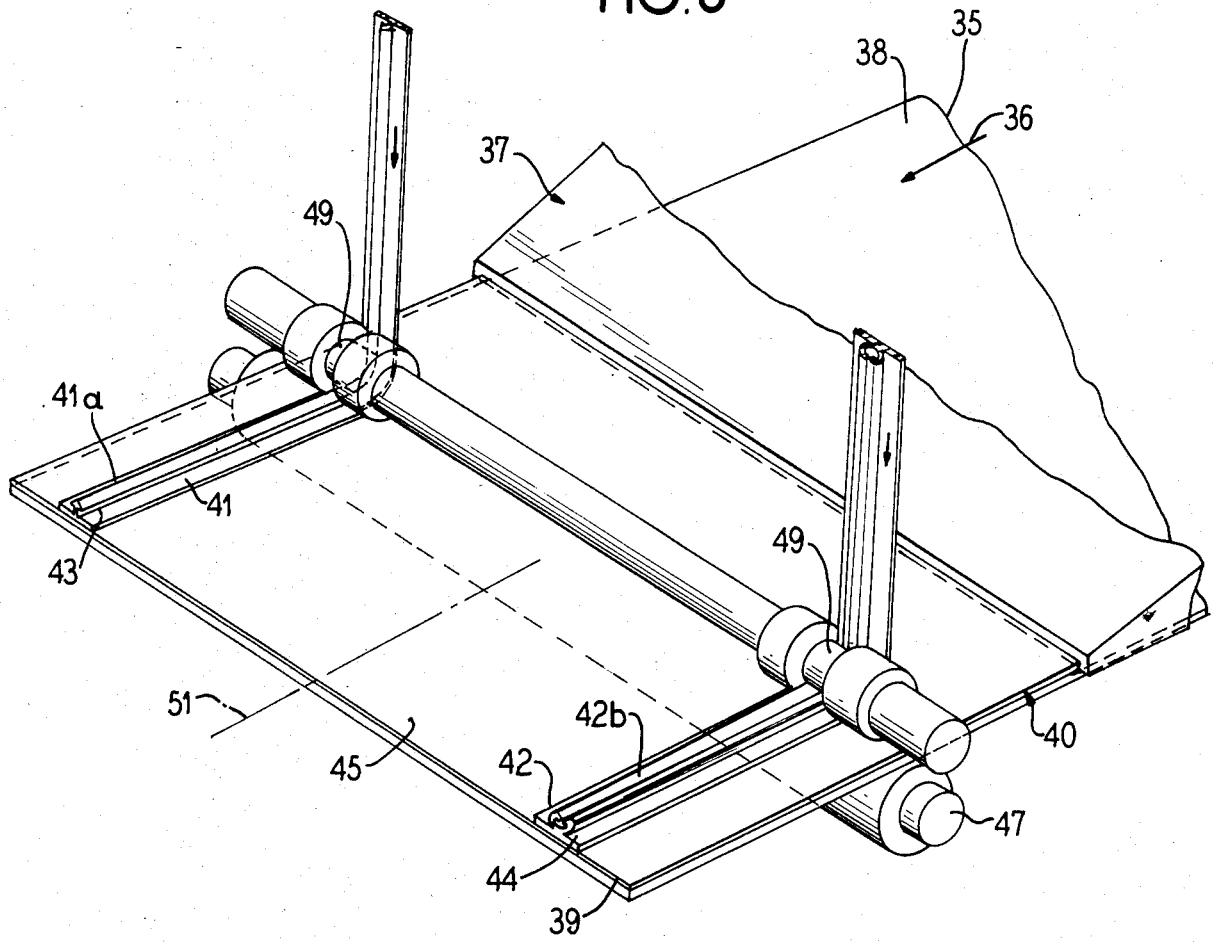
FIG. 3 is a perspective view of one embodiment of apparatus suitable for practicing the method according to the present invention.

Referring to FIG. 3, one embodiment of a system for the practice of the present invention is seen. Here, a thin film or web 35, for example, extruded polyethylene, is advanced in a continuous fashion along the direction of a longitudinal axis which extends perpendicularly to the plane of the drawing as illustrated by arrow 36. If desired, the web 35 can range from about one to two mils in thickness.

As web 35 advances, a thin layer 39 of a thermoplastic, for example, ethylene-vinyl acetate, is extruded from a die 37 onto substantially the entire surface 38 of web 35 and the freshly extruded resulting layer 39 bonds uniformly and continuously to the web 35 so that a composite laminate 40 of two layers results. If desired, the layer 39 can range from about one to two mils in thickness.

Parallel to the direction of travel of the laminate 40, and in the vicinity of each of the exposed side edges of the laminate 40, two resiliently flexible closure or fastener strips 41 and 42 are advanced at the same speed. In the embodiment shown, one of these fastener strips has a male interlocking profile 41a and the other has a female interlocking profile 42b. The fastener strips 41 and 42 are comprised, for example, of extruded polyethylene (and are comparable to the strips 21 and 22 of the structure shown in FIGS. 1 and 2).

The fastener strips 41 and 42 are provided with base webs 43 and 44, respectively, which are continuously brought into direct contact with the surface 45 of layer 39 while the layer 39 is still in an adhesive state following its formation through die 37. While the layer 39 is in such adhesive state, the back surface or contacting layer of each of the webs 43 and 44 readily directly bonds thereto to form a composite laminate structure wherein the layer 39 is the sole bonding agent between the base webs 43 and 44 and the base layer web 35. If desired, at the time of bonding, the layer 39 may have a temperature ranging from about 300° F. to 380° F.

For effecting a desired relatively rapid movement and guidance of the laminate 40, and of the fastener strips 41 and 42, a rotary pressure roll 47 is provided beneath the laminate 40 and above roll 47 is positioned rotary pressure roll 48 which has annular grooves 49 to provide for the passage of, and straight guidance of, the fastener strip profiles 41 and 42 relative to laminate 40.

Thereafter, the composite laminate structure bearing the fastener strips 41 and 42 bonded thereto may be coiled for storage (not shown) or folded along its longitudinal axis 51 so as to produce superimposed sheet portions wherein the fastener strips 41 and 42 are brought into facing relationship relative to one another and the profiles thereof are generally aligned for being eventually interlocked in a bag structure.

Thereafter, in a subsequent stage, the two opposite side walls corresponding to the walls 13 and 14 in bag 10 are transversely joined along bond lines and cut, joining being accomplished, for example, by welding at predetermined intervals corresponding to desired bag widths. Thereby, bags with a closed bottom fold are obtained similar to the fold 15 in the bag 10. In the joining procedure, the ends of the closure strips 41 and 42 are also welded together at the same time as the walls 13 and 14 are formed. Folding of the resulting laminate usually takes place along a fold line generally midway between each one of the fastener strips 41 and 42 so as to bring these strips into the desired opposed, generally aligned superimposed relationship relative to each other in the completed bag.

As a result of the flexibility of the sheets 11 and 12, and also of the fastener 17, the open end 16 may be readily collapsed or squeezed together by the application of a lateral force acting along the longitudinal axis of the male and female elements 18 and 19.

It will be understood that variations in modification may be effected without departing from the spirit and scope of the novel concepts of this invention.

I claim:

1. A method of producing a multi-layered reclosable bag making material assembly comprising the steps of sequentially:

continuously coating over essentially the entire area of a moving continuous substrate layer, a continuous fluent layer of resin, and thereby directly laminating the resulting said resin layer to said substrate; and immediately thereafter, while said so-coated resin layer is still in an adhesive state on said substrate, continuously applying to said resin layer, a reclosable fastener strip means, and thereby solely by means of said still adhesive state resin layer directly bonding said fastener means to said resin layer.

2. The method of claim 1 wherein said substrate and said fastener means are each comprised of polyethylene and said resin layer is comprised of ethylene-vinyl acetate.

3. The method of claim 1 wherein said fastener strip means comprises a pair of strips, each one of said strips being in spaced, generally parallel relationship relative to the other, said strips forming cooperating respective male and female interlockable elements.

4. A method for making a multi-layered reclosable bag making material comprising the steps of sequentially:

continuously extrusion coating a continuous layer of ethylene-vinyl acetate over essentially the entire area of a continuous layer of polyethylene substrate, thereby directly bonding said polyethylene substrate layer to said ethylene-vinyl acetate layer;

immediately thereafter and while said coating layer is still adhesive continuously applying the base face of a reclosable fastener strip means comprised of polyethylene upon said still adhesive coating layer of ethylene-vinyl acetate along a predetermined longitudinal path, and thereby forming a composite wherein said fastener strip is directly bonded to said coating layer of ethylene-vinyl acetate and is solely by said coating layer bonded to said substrate layer and without intervention of any other bonding means.

5. A plastic bag comprising:

a pair of superimposed sheet wall portions the corresponding side edges of which adjoin to form closed sides and an open side;

each of said wall portions being comprised of a laminate wherein a continuous outside layer is comprised of polyethylene and an overall essentially entire area inside layer is comprised of ethylene-vinyl acetate, said outside layer being directly bonded to said inside layer;

polyethylene strip means forming longitudinally continuous cooperating interlockable elements, said strip means being directly bonded, without the intervention of any other bonding means, to each said inside layer adjacent to said open side and by such bonding to said inside layer being bonded to said outside layer;

said interlockable elements being in opposed, generally aligned relationship relative to each other, thereby to provide a reclosable fastening means.

* * * * *